US009251691B2

(12) United States Patent
Wilmeth et al.

(10) Patent No.: US 9,251,691 B2
(45) Date of Patent: Feb. 2, 2016

(54) SYSTEMS AND METHODS FOR BEHAVIOR MONITORING AND IDENTIFICATION

(75) Inventors: Brett Wilmeth, Smyrna, GA (US); Kenneth L. Dalley, Otsego, MN (US)

(73) Assignee: Codex Corporation, Maple Grove, MN (US)

( * ) Notice: Subject to any disclaimer, the term of this patent is extended or adjusted under 35 U.S.C. 154(b) by 347 days.

(21) Appl. No.: 13/175,504

(22) Filed: Jul. 1, 2011

(65) Prior Publication Data

US 2013/0002433 A1 Jan. 3, 2013

(51) Int. Cl.

| | |
|---|---|
| ***G08B 21/20*** | (2006.01) |
| ***G07C 9/00*** | (2006.01) |
| ***G08B 21/02*** | (2006.01) |

(52) U.S. Cl.

CPC ..... *G08B 21/20* (2013.01); *G07C 9/00111* (2013.01); *G08B 21/0275* (2013.01)

(58) Field of Classification Search

CPC .. G08B 21/20; G08B 21/202; G08B 21/0275; G07C 9/00111

USPC ..... 340/573.4, 573.1, 539.3; 379/38

See application file for complete search history.

(56) References Cited

U.S. PATENT DOCUMENTS

| | | | | |
|---|---|---|---|---|
| 5,461,390 | A * | 10/1995 | Hoshen | 342/419 |
| 7,102,509 | B1 * | 9/2006 | Anders et al. | 340/539.13 |
| 2002/0067272 | A1 * | 6/2002 | Lemelson et al. | 340/573.4 |
| 2005/0088302 | A1 * | 4/2005 | Pucci et al. | 340/568.1 |
| 2008/0088437 | A1 * | 4/2008 | Aninye et al. | 340/539.13 |
| 2010/0253521 | A1 * | 10/2010 | Williams et al. | 340/572.1 |

* cited by examiner

*Primary Examiner* — Steven Lim
*Assistant Examiner* — Hongmin Fan
(74) *Attorney, Agent, or Firm* — Schwegman Lundberg & Woessner, P.A.

(57) ABSTRACT

Various embodiments herein provide system, method, and software solutions to facilitate not only timely, compliant monitoring of individuals housed within facilities, such as detention facilities, but also solutions that discover visible and latent behavior and mental conditions, among other potential issues that may be easily overlooked. Some embodiments focus on data collection and other embodiments focus on applying analytics to collected data to discover conditions and states of individuals, groups, a facility or portion thereof, staff, and procedures. Yet further embodiments include both data collection and analytic discovery. Some embodiments may also include messaging and other data processing and communication mechanisms implemented to facilitate compliance, safety, and monitoring accuracy.

15 Claims, 6 Drawing Sheets

SYSTEMS AND METHODS FOR BEHAVIOR MONITORING AND IDENTIFICATION

BACKGROUND INFORMATION

Monitoring behaviors, including movements, of individuals within a facility, such as prisoners within a detention facility, is challenging. Laws, regulations, generally accepted best practices, insurance policies, and local policies often dictate intervals and conditions for individual behavior monitoring. Further, for organizations supervising individuals within their facilities, certain duties of care for those individuals are required. The larger the facility, the greater the challenges in meeting these requirements. Further compounding such challenges is that employees who monitor and supervise individuals within a facility during certain times may not be the same employees monitoring the same individuals at a different time.

DETAILED DESCRIPTION

Figure 1:
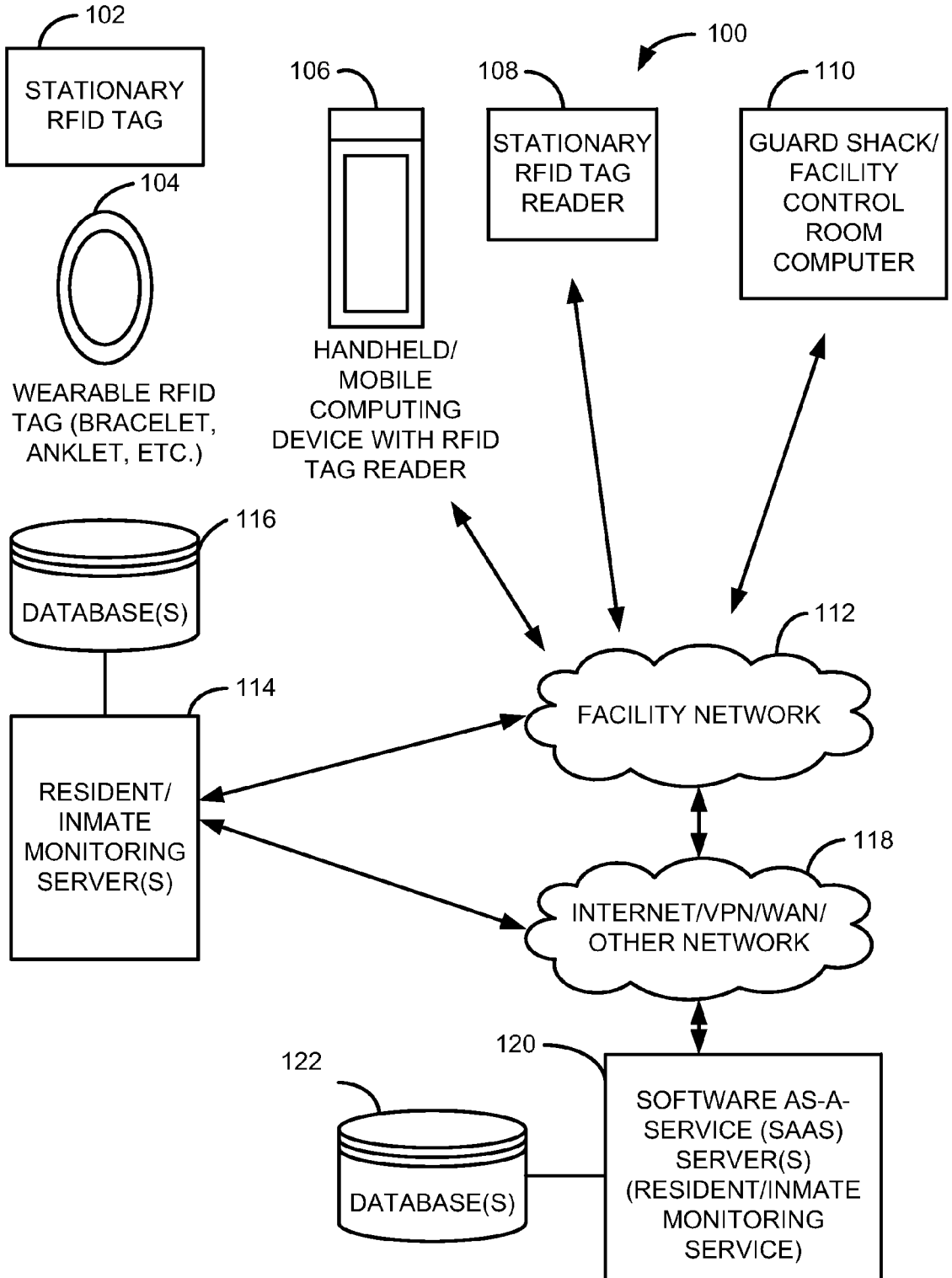
FIG. 1 illustrates a behavior monitoring and identification system, according to an example embodiment.

Various embodiments illustrated and described herein provide solutions to facilitate not only timely, compliant monitoring of individuals housed within facilities, such as detention facilities, but also solutions that discover visible and latent behavior and mental conditions, among other potential issues that may be easily overlooked. Some embodiments focus on data collection and other embodiments focus on applying analytics to collected data to discover conditions and states of individuals, groups, a facility or portion thereof, staff, and procedures. Yet further embodiments include both data collection and analytic discovery. Some embodiments may also include messaging and other data processing and communication mechanisms implemented to facilitate compliance, safety, and monitoring accuracy. These and other embodiments are described, with reference to the figures, herein.

In the following detailed description, reference is made to the accompanying drawings that form a part hereof, and in which is shown by way of illustration specific embodiments in which the inventive subject matter may be practiced. These embodiments are described in sufficient detail to enable those skilled in the art to practice them, and it is to be understood that other embodiments may be utilized and that structural, logical, and electrical changes may be made without departing from the scope of the inventive subject matter. Such embodiments of the inventive subject matter may be referred to, individually and/or collectively, herein by the term "invention" merely for convenience and without intending to limit the scope of this application to any single invention or inventive concept if more than one is in fact disclosed. The following description is, therefore, not to be taken in a limited sense, and the scope of the inventive subject matter is defined by the appended claims.

The functions or algorithms described herein are implemented in hardware, software, or a combination of software and hardware in one embodiment. The software comprises computer executable instructions stored on computer readable media such as memory or other type of storage devices. Further, described functions may correspond to modules, which may be software, hardware, firmware, or any combination thereof. Multiple functions are performed in one or more modules as desired, and the embodiments described are merely examples. The software is executed on a digital signal processor, ASIC, microprocessor, or other type of processor operating on a system, such as a personal computer, server, a router, or other device capable of processing data including network interconnection devices.

Some embodiments implement the functions in two or more specific interconnected hardware modules or devices with related control and data signals communicated between and through the modules, or as portions of an application-specific integrated circuit. Thus, the exemplary process flow is applicable to software, firmware, and hardware implementations.

FIG. 1 illustrates a behavior monitoring and identification system 100, according to an example embodiment. The system 100 is a system that facilitates timely, compliant monitoring of individuals housed within facilities, such as detention facilities, and includes mechanisms that discover visible and latent behavior and mental conditions, among other potential issues that may be easily overlooked. At least some portions of the system 100 are deployed within a facility. The facility in one embodiment is a detention facility, such as a prison or jail. In other embodiments, the facility may be a hospital, daycare center, school, or other facility where individuals are monitored.

The system 100 includes identification tagging and identification tag reading devices. In the illustrated embodiment of the system 100, the identification tags are Radio Frequency Identification (RFID) tags, such as stationary RFID tag 102 and wearable RFID tag 104. The system 100 also includes RFID tag reading devices, such as stationary RFID tag reader 108 and portable computing device 106 that includes an RFID reader. In other embodiments, the identification tags and identification tag readers may be bar codes and bar code scanners, respectively. However, RFID tags, in some embodiments, provide an additional data integrity advantage as RFID tags are more difficult to replicate than many other forms of tagging.

In some embodiments, individuals monitored within a facility wear a wearable RFID tag 104. The wearable RFID tag 104 may be a bracelet, anklet, necklace, or other wearable item with an RFID tag deployed therein. Stationary RFID tags 102 may be deployed at various locations throughout the facility, such as at an entrance or within a room, cell, passageway, or other location. When an RFID tag is read by an RFID reading device, such as by a stationary RFID tag reader 108 and portable computing device 106 that includes an RFID reader, additional system 100 functionality is invoked as will be discussed further below.

The system 100 includes the portable computing device 106 of which there can be many, stationary RFID tag readers 108, and at least one control room computer 110 coupled to at least one network. The at least one network may include one or more of a facility network 112 and another network 118, such as the Internet, a Virtual Private Network (VPN), a Wide Area Network (WAN), or other network types. Connections to the at least one network may be by one or both of wired and wireless connections.

The portable computing device 106 may be one or several types of computing devices. Such computing devices may include handheld computers, smartphones, tablet computing devices, laptop computers, and the like. The portable computing devices 106 may each operate one of many different portable computing device operating systems, such as WINDOWS® MOBILE available from Microsoft Corporation of Redmond, Wash., ANDROID® available from Google Inc. of Mountain View, Calif., or other portable computing device operating system.

The portable computing device 106 also includes an identification tag reading device, such as an RFID tag reader. The identification tag reading device may be integrated within the portable computing device 106, attached thereto, communicate with the portable computing device such as through a wireless BLUETOOTH® connection, or otherwise be in communication with the portable computing device. The tag reading device is utilized to scan identification tags, such as an RFID tag reading device that reads stationary RFID tags 102 and wearable RFID tags 104. When an identification tag is read, a code is obtained by an inmate and facility monitoring program that executes on the portable computing device 106. In some embodiments, the code is obtained from data local to the portable computing device, while in other embodiments the code may be retrieved over a network. In yet other embodiments, the code is obtained, as well as other data, from stored in an RFID tag. Such additional data may include an individual's name, assigned identifier number, and other individual-specific data. Further details with regard to the inmate and facility monitoring program are provided below.

Also connected to the at least one network, may be one or both of one or more resident monitoring servers 114 and one or more software-as-a-service (SaaS) servers 120. Both the resident monitoring servers 114 and software-as-a-service servers 120 execute software to receive and store data from portable computing devices 106, control room computers 110, stationary identification tag reading devices such as stationary RFID tag readers 108, and other devices deployed within a particular embodiment of the system 100. Both the resident monitoring servers 114 and software-as-a-service servers 120 include at least one respective database 116, 122. The databases 116, 122 may also store configuration data, metrics to apply against data to identify compliance issues, ensure compliance standards are maintained, generate messages, identify behavior or mental conditions of individuals based on received behavioral data, and other data.

The resident monitoring servers 114 and software-as-a-service servers 120 may be selectively implemented depending on the requirements of a particular embodiment. For example, a particular facility may require a local facility deployment of the system 100. In such embodiments, the network may include just the facility network 112 and a local installation of the resident monitoring server(s) 114 and database 116. In other embodiments, the system 100 may be deployed through a software-as-a-service model where the software-as-a-service servers 120 and database 122 are accessible via the local facility network 112 that is coupled to another network 118 such as the Internet. Hybrid deployments that utilize both resident monitoring servers 114 software-as-a-service servers 120 may also be implemented in some embodiments where various data storage and data processing tasks may be shared, backed up, or delegated between the two.

Control room computers 110 are computers that include software or can access software, such as through a web browser application, via one or both of the facility network 112 and the one or more other networks 118. The control room computers 110 may be physically located in a facility control room, but need not be and may also be portable computing devices such as a laptop computer, tablet computer, or other computing device capable of executing software or a web browser. The control room computers 110 provide report viewing, data oversight, configuration, data viewing, and other such capabilities.

The system 100, according to some embodiments, includes at least one portable computing device 106. Each of the at least one portable computing devices 106 include at least one mobile device processor, at least one memory device, at least one input device, a display device which may be a touchscreen, and a network interface device. Stored in the at least one device is instructions that are executable by the at least one mobile device processor to perform data processing actions. These data processing actions may include retrieving, from a database stored in the at least one memory device of the portable computing device, and present, via the display device, information based on identifier input received via the at least one input device. The at least one input device may be an RFID tag reader that scanned an RFID tag of an individual, such as an inmate wearing a wearable RFID tag 104. The data processing activities may further include receiving selection input of at least a portion of the information presented via the display device, the selection input representative of at least one behavior of the inmate wearing the RFID tag 104.

The information presented via the display device is generally information retrieved based on the scanned RFID tag. In this embodiment, the information includes information retrieved, includes data associated with the scanned RFID tag 104 of the inmate. The retrieved information associated with the inmate may include information such as a name, current location, any warnings regarding the inmate such as a tendency for violence against correctional officers, and potential behaviors of that inmate. The potential behaviors are presented as selectable items within the user interface. Such behaviors may include actions such as eating, sleeping, fighting, exercising, and the like. Such behaviors may be descriptive or qualitative such as heavily, slowly, quietly, and the like. Such behaviors may also include nouns such as bed, desk, cell, floor, and the like. Multiple potential behaviors may be selected and submitted. Through selection of multiple potential behaviors, a data picture of the inmate's behavior can be gathered quickly and accurately. Such as "exercising" "cell" "floor" "heavily." An example of a user interface that presents such information is illustrated and described herein with regard to FIG. 2. The selectable items within the user interface are at time herein referred to as "word blocks."

Following receipt of the selection input received via the display device of the portable computing device 106, the data processing actions further include the portable computing device sending the received selection input, via the network interface device over at least one of the networks 112, 118, to one or both of the resident monitoring servers 114 and software-as-a-service servers 120.

The resident monitoring server 114 and software-as-a-service server 120 generally both include at least one computer processor, at least one memory device, and a network interface device. Both also include instructions stored on the at least one memory device and executable by the at least one computer processor to process data. For example, both the resident monitoring server 114 and the software-as-a-service server 120, through execution of the instructions, are operable to receive, via the network interface device of the inmate-monitoring server, the selection input from the portable computing device. The received selection input may be representative of the at least one behavior of an inmate. The received data may then be stored, such as in a database with additional data indicating a time the data was received. The respective resident monitoring server 114 and software-as-a-service server 120 of the particular embodiment may then apply at least one behavior analytic to the data stored in the behavior database including the data received with regard to the inmate to determine if the at least one behavior analytic rule is implicated. When at least one behavior analytic rule is implicated, the resident monitoring server 114 or software-as-a-service server 120 applying the rule may then perform an action as included in the respective behavior analytic rule implicated. Such an action may include sending a message, generating a new data record in the database indicating the inmate may have a particular behavior, mental, health, or other condition, such as a risk for suicide, pneumonia, depression, among many other possibilities. The behavior analytic rules stored in the database may be included in the server software off the shelf, added by an administrator such as through a control room computer 110, obtained from a third party, or have originated elsewhere.

While referred to as behavior analytic rules which are generally described with regard to an individual, such rules may also exist or be generated for other purposes. For example, a rule may be generated to identify dangerous locations within a facility for fights to occur, slip and fall accidents, and correctional officer assaults. Generally, a behavior analytic rule is a programming or scripting construct that defines data conditions, which indicate what the behavior analytic rule is intended to identify. Such rules may evaluate more than one particular data value. In some embodiments, a rule may assign relative values to data values, such as word blocks or other data that utilized in particular embodiments to represent observed behaviors, retrieved from the database of individual behavior data and weight contributions of other data. Some behavior analytic rules may be more analytic in nature and search for trends and relationships between behavior data of multiple individuals, locations, and other factors. However, some behavior analytic rules may be relatively simple such as tracking compliance with a periodic visual check required by statute, regulation, best practices, local policies, inmate or patient medical conditions, or even insurance companies. Thus, behavior analytic rules may be defined and implemented for various purposes.

In some embodiments, behavior analytic rules may be defined with regard to particular data that is received from the portable computing devices 106. The particular data may be the data described above as data indicative of potential behaviors such as actions, qualifiers, and nouns. The data indicative of potential behaviors is typically input into the portable computing devices 106, received over one of the networks 112, 118 by the resident monitoring server 114 or the software-as-a-service server 120, and stored in a database 116, 122. The data indicative of potential behaviors will then be evaluated by the behavior analytic rules. Individual behavior analytic rules may also include data that specifies when it is to be applied, such as periodically (hourly, daily, monthly, etc.) or immediately upon receipt of data indicative of particular potential behaviors.

In some embodiments, when a new behavior analytic rule is defined or deployed, the behavior analytic rule may include new data indicative of potential behaviors. In such instances, data present in a database local to the portable computing devices 106, or retrievable thereby, may be updated. The selectable items presented within the user interface provided the portable computing devices 106 then include the new data indicative of potential behaviors.

In some embodiments, the local portable computing device 106 database may also include data associated with RFID tags, such as stationary RFID tags 102 and wearable RFID tags 104. The data associated with the RFID tags may be data of inmates, correctional officers, other facility staff or visitors, locations, equipment, and implements. Thus, when a particular RFID tag, or other identification tag, is scanned by a portable computing device 106, data associated with the scanned RFID tag is readily available and can be displayed via the display device.

Figure 2:
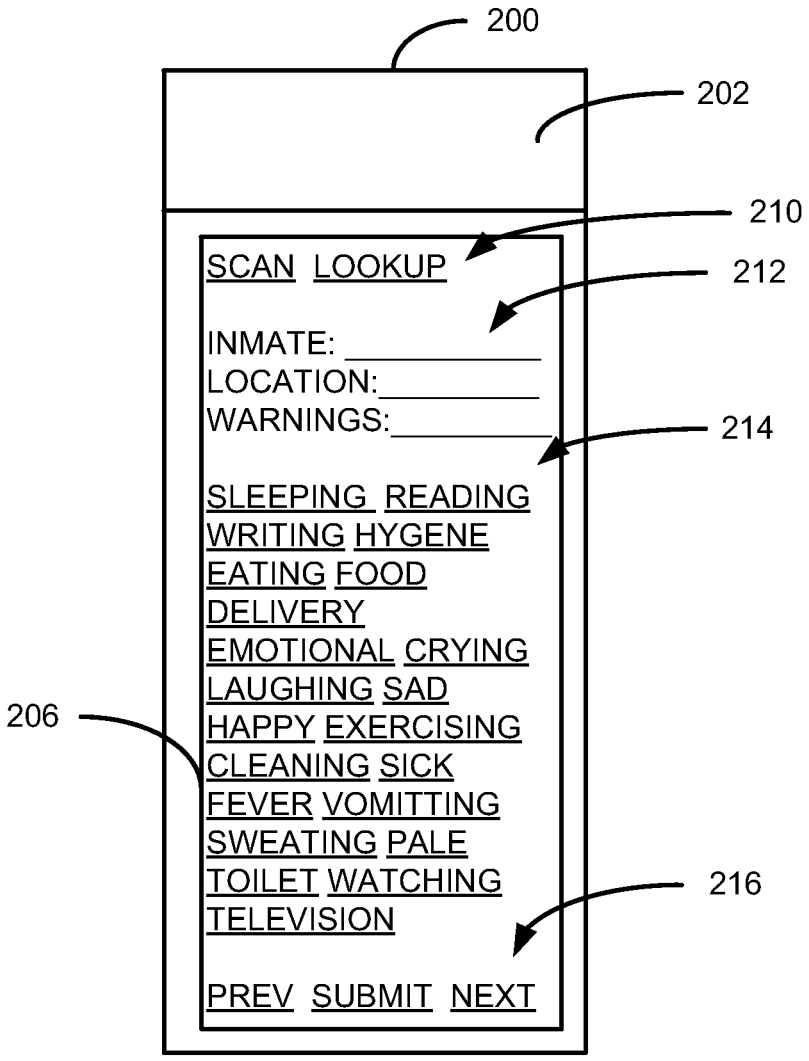
FIG. 2 is a block diagram of a portable computing device and user interface illustration, according to an example embodiment.

FIG. 2 is a block diagram of a portable computing device 200 and user interface illustration, according to an example embodiment. The portable computing device 200 includes an identification tag reader 202 and a touch-screen display device 206. Although FIG. 2 is illustrated and described as including the touch-screen display device 206, other embodiments may utilize non-touchscreen displays and other input devices, such as keyboards, trackballs, touch pads, and other pointing devices.

The identification tag reader 202 may be an RFID tag reader. The RFID tag reader may be one or both of an active and passive RFID tag reader. Such RFID tag readers, and the RFID tags that they read, may be high frequency (HF), very high frequency (VHF), ultrahigh frequency (UHF), or other frequency range depending on the RFID tags deployed in the particular embodiment and the active and passive RFID solutions chosen therefore.

The touch-screen display device 206, in the illustrated embodiment, provides a user interface including the potential behaviors that are presented as selectable items as described above. In use however, a user of the portable computing device 200 may first input an individual, such as an inmate, or a location within a facility. The input may occur through selection of an acquire input item 210, such as by tapping a finger or stylus on the touch-screen display device 206. The acquire input items 210 include a SCAN option which will cause the portable computing device 200 to utilize the identification tag reader 202 to scan an identification tag to obtain an identification tag identifier. The portable computing device 200 then utilizes that identification tag identifier to retrieve data associated therewith, such as an inmate or location name and potential warnings or other messages associated therewith. The data may be retrieved from a database local to the portable computing device 200 or via a wireless network from a database, such as one of databases 116 and 122 illustrated and described with regard to FIG. 1. Instead of the SCAN option, the user may instead select from the acquire input items 210 options LOOKUP. This option allows a user to query a local or remote database either directly based on a name or other data of an individual or location. An individual or location may then be selected.

Once a acquire input item 210 has been selected and the appropriate data is obtained, at least some of that data may be presented in an inmate/location portion 212 of the user interface. For example, one or both of an individual or location name and facility identifier may be presented along with potential warnings or other messages associated therewith. In some embodiments, following an acquisition of an individual, such as through the scanning of an RFID tag of the individual, an option is provided to scan another RFID tag associated with a location where the individual is located. In such embodiments, the individual's data is retrieved and presented and the location where the individual is presented.

Following acquisition and presentation of individual and/or location data, items associated with potential behaviors are presented as selectable items within a behavior portion 214 of the user interface. The items associated with potential behaviors may be retrieved from a local or remote database based on the individual and/or location data. For example, when an individual that is an inmate in a corrections facility is acquired, the items associated with potential behaviors will be different from items acquired for a location such as a shower facility. Further, depending on a location of the inmate, the items associated with potential behaviors that are retrieved may differ, such when the inmate is located in a cell versus when the inmate is located in a lunchroom.

The items associated with potential behaviors are generally represented as words descriptive of potential behaviors, which when selected may be highlighted, bolded, added to a displayed listing of selected items, or are otherwise indicated within the user interface to have been selected. The user interface may also provide an option to deselect. The user interface also includes a page and submit area 216 that allows a user to page through multiple pages of selectable items in the behavior portion 214 of the user interface. The page and submit area 216 also includes a SUBMIT option which will cause data representative of the selected items and the particular inmate and/or location the input is received for to be submitted. The submission of the data will typically occur via a wireless network from the portable computing device 200. However, the submission may alternatively occur upon physically coupling the portable computing device to another computer or wired network in instances where the wireless network is unavailable or the data could not be submitted via the wireless network, including embodiments where there actually is no wireless network.

Through various embodiments of the user interface presented on the touch-screen display device 206 of the portable computing device 200, the behaviors of an individual and the behaviors generally being exhibit in a particular location can be input quickly and easily within a relevant context.

Figure 3:
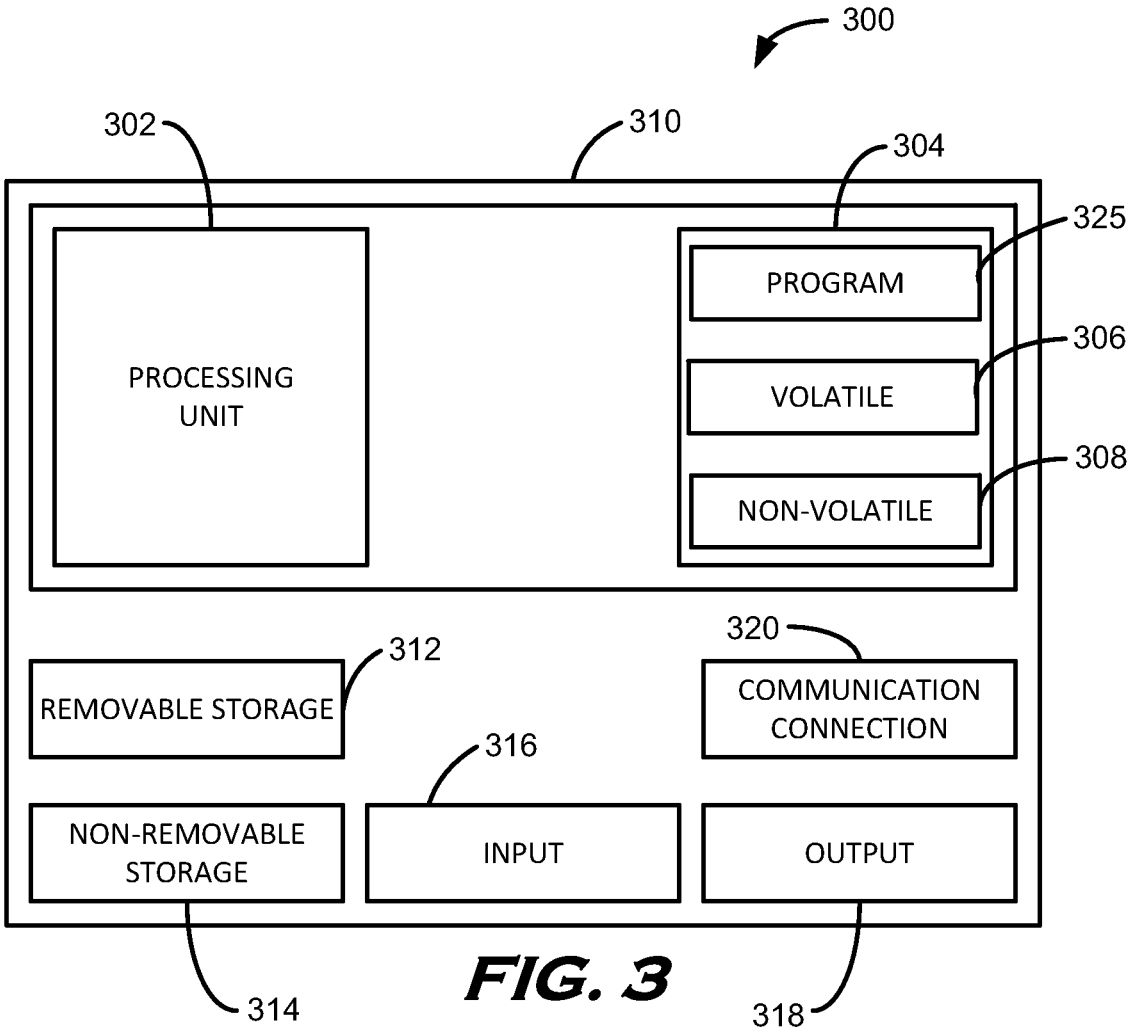
FIG. 3 is a block diagram of a computing device according to an example embodiment.

FIG. 3 is a block diagram of a computing device, according to an example embodiment. The computing device of FIG. 3 is intended to generally represent the hardware and software components that may be present, in various embodiments, of one or all of the resident monitoring servers 114, software-as-a-service servers 120, portable computing devices 106, and control room computers 110 illustrated and described with regard to FIG. 1 and the portable computing device 200 of illustrated and described with regard to FIG. 2. In one embodiment, multiple such computer systems are utilized in a distributed network to implement multiple components in a transaction-based environment. An object-oriented, service-oriented, or other architecture may utilized to implement such functions and communicate between the multiple systems and components. One example computing device in the form of a computer 310 may include at least one processing unit 302, at least one memory 304, at least one removable storage 312, and at least one non-removable storage 314. The at least one memory 304 may include volatile memory 306 and non-volatile memory 308. Computer 310 may include—or have access to a computing environment that includes—a variety of computer-readable media, such as volatile memory 306 and non-volatile memory 308, removable storage 312 and non-removable storage 314. Computer storage includes random access memory (RAM), read only memory (ROM), erasable programmable read-only memory (EPROM) & electrically erasable programmable read-only memory (EEPROM), flash memory or other memory technologies, compact disc read-only memory (CD ROM), Digital Versatile Disks (DVD), Compact Flash (CF), Secure Digital (SD), or other optical disk storage, magnetic cassettes, magnetic tape, magnetic disk storage or other magnetic storage devices, or any other medium capable of storing computer-readable instructions. Computer 310 may include or have access to a computing environment that includes input 316, output 318, and a communication connection 320. The computer may operate in a networked environment using a communication connection to connect to one or more remote computers, such as database servers. The remote computer may include a personal computer (PC), server, router, network PC, a peer device or other common network node, or the like. The communication connection may include a Local Area Network (LAN), a WAN, the Internet, or other networks. The communication connection may be made via one or more of wired and wireless network connections. The wireless connections may include a wireless connection utilizing a device capable of communicating on one or more wireless network types, such as WiFi, WiMAX, Long Term Evolution (LTE), CDMA, EDGE, GSM, or other wireless network type.

Computer-readable instructions stored on a computer-readable medium are executable by the processing unit 302 of the computer 310. A hard drive, CD-ROM, and RAM are some examples of articles including a computer-readable medium. For example, a computer program 325 capable of presenting a user interface as illustrated in FIG. 2 to collect and submit data over a network for storage in a database. In another example, the computer program 325 may be capable of applying behavior analytic rules to at least one of received and stored data to identify potential behaviors and to perform compliance monitoring. In yet other embodiments, the computer program 325 may include instructions executable by the at least one processing unit 302 to cause the computer 310 to perform one or more of the method described herein.

Figure 4:
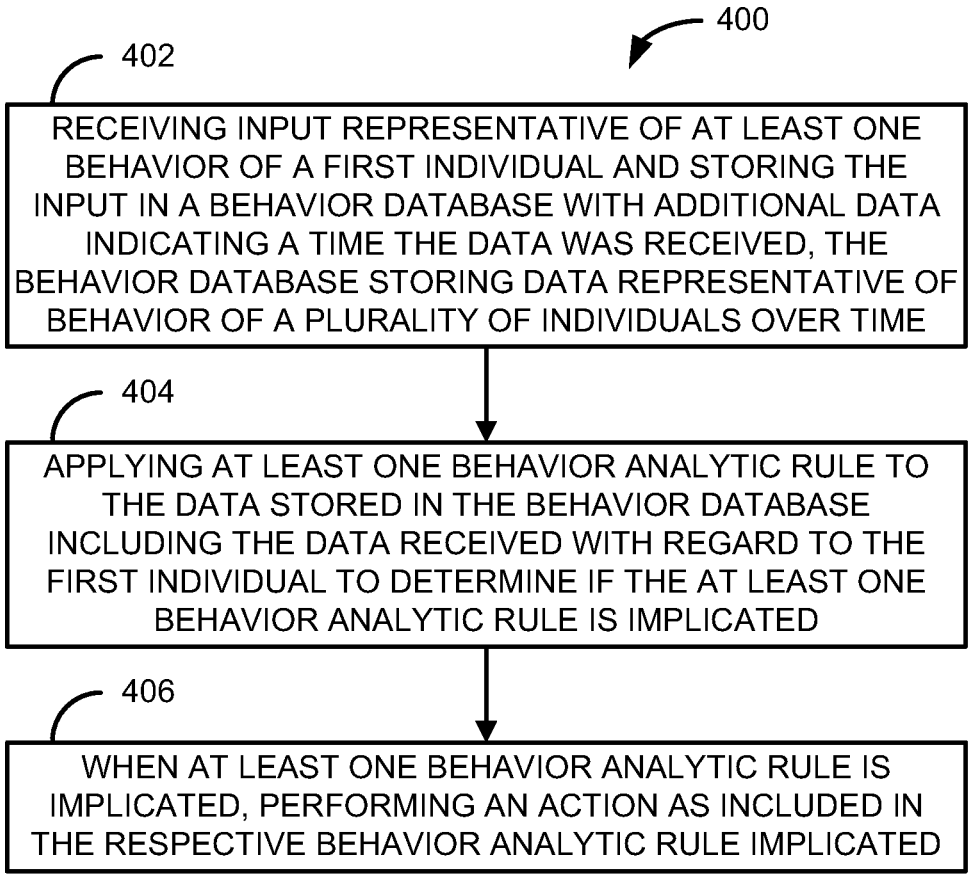
FIG. 4 is a block diagram of a method, according to an example embodiment.

FIG. 4 is a block diagram of a method 400, according to an example embodiment. The method 400 is an example of a method that may be performed to identify compliance issues, ensure compliance standards are maintained, generate messages, identify behavior or mental conditions of individuals based on received behavioral data, and other goals and purposes. The method 400 is typically performed on a server, however the method 400 may alternatively be performed on another computing device.

The illustrated embodiment of the method 400 includes receiving 402, via a network, input representative of at least one behavior of a first individual and storing the input in a behavior database with additional data indicating a time the data was received. The data representative of the at least one behavior of the first individual may represent one or more of an event, action, or activity by or associated with the first individual. The behavior database, in some such embodiments, stores, among other data, data representative of behavior of a plurality of individuals over time. The method 400 further includes applying 404, through execution of instructions on a computer processor, at least one behavior analytic rule to the data stored in the behavior database including the data received with regard to the first individual to determine if the at least one behavior analytic rule is implicated. When at least one behavior analytic rule is implicated, the method 400 may include performing 406 an action as included in the respective behavior analytic rule implicated. Performing 406 such an action may include one or both of sending a message via the network to at least a client application from which the input was received and modifying a monitoring schedule for the first individual. A message action may include sending of a message to a facility management system that control physical security devices of the facility. The physical security devices may include locks, gates, sirens, lighting, and other electronically controllable devices within a facility.

In some embodiments of the method 400, the at least one behavior analytic rule defines an area in which access by the first individual is restricted, such as a time restriction or total exclusion. In such embodiments, upon receiving input indicating presence of the first individual in the restricted area, the method 400 triggers performance of a particular action. The presence of the individual within a particular area may be received or identified in data received and stored in the database from a stationary RFID tag reader, a portable computing device, or other device, mechanism, or process that causes location data with regard to the first individual to be received and stored.

The received input representative of at least one behavior according to some embodiments of the method 400 includes data identifying a location of the behavior of the first individual. The at least one behavior analytic rule may also include a behavior analytic rule that retrieves a location of a second individual from data stored in the behavior database with regard to the second individual. Such a behavior analytic rule may be implicated when the first and second individuals are within a defined proximity of one another. Such rules may be established when the first and second individuals are known to fight with one another, have a susceptibility to a communicable illness of the other, or for other reasons.

In some embodiments of the method 400, the received input representative of at least one behavior includes data representative of a symptom associated with a potential condition represented by a condition behavior analytic rule. Applying the condition behavior analytic rule in such embodiments identifies data representative of behaviors of the first individual stored in the database that are identified in the condition behavior analytic rule as associated with behaviors of the potential condition. The condition behavior analytic rule may weight one or more particular behaviors in determining whether the condition behavior analytic rule is implicated.

Monitoring and tracking of movements within and between facilities may also be assisted through various embodiments of the method 400. In one such embodiment, the received input of the method 400 includes an identifier of a movement behavior, an identifier of the first individual, data representative of a current location of the first individual within a facility, and a destination location. In such embodiments, the implicated at least one behavior analytic rule includes a rule implicated by the identifier of the movement behavior. This implicated behavior analytic rule then watches for receipt of subsequent input within a period according to the implicated behavior analytic rule. The subsequent input may be input indicating the first individual has arrived at the destination location. If the subsequent input of arrival, or other suitable input, is not received prior to expiration of the period, performance of the action of the at least one behavior analytic rule is triggered. Through such movement monitoring embodiments, historical movement data is acquired over time and stored. Thus, users may query historical movements. The movement data, in some embodiments, may be plotted on a graphical map image of a facility.

Another movement embodiment includes monitoring progress of the first individual along a movement path. In some such embodiments of the method 400 further input with regard to the movement behavior is received. The further input defines a path of input mechanisms, such as RFID tag readers, which may be active or passive RFID tag readers. The path of input mechanisms defines a path between the current location of the first individual within the facility and the destination location. As the first individual progresses along the path, the RFID tag of the individual is read, such as a wearable RFID tag that is read by a stationary RFID tag reader. The reading of the RFID tag is provided as data to a system performing the method 400 according to such embodiments. The path of input mechanisms defines a temporary behavior analytic rule with regard to the first individual. Upon receipt of further input from an input mechanism not included in the path of input mechanism triggers performance of at least one action, such as an alert action, a lockdown action, or other action.

Figure 5:
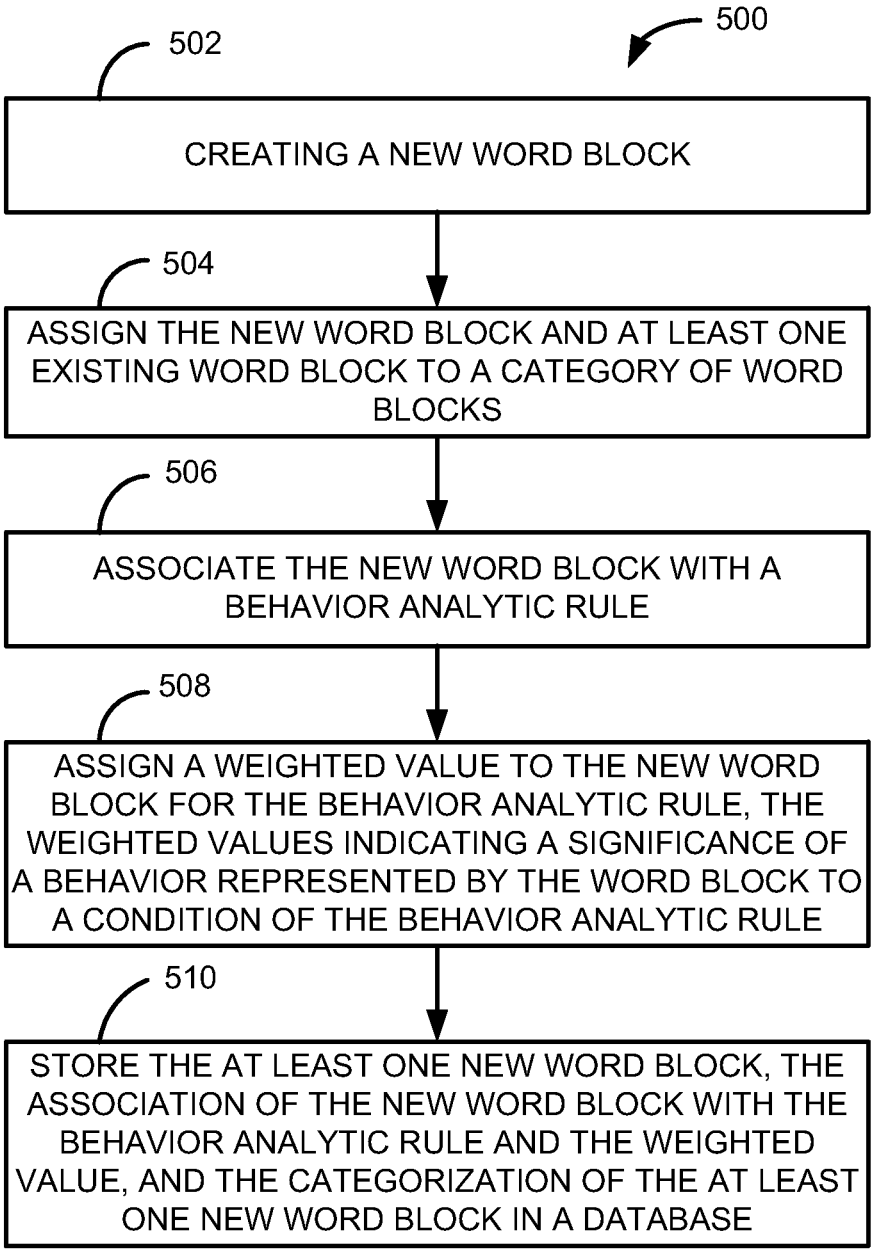
FIG. 5 is a block diagram of a method, according to an example embodiment.

FIG. 5 is a block diagram of a method 500, according to an example embodiment. The method 500 is an example of a method 500 that may be performed to define new word blocks such as may be displayed within a user interface of a portable computing device, such as is illustrated in FIG. 2, to receive input with regard to observed behaviors that are the subject of behavior analytic rules. The method 500 includes creating 502 a new word block representative of a potential behavior and assigning 504 the new word block and at least one existing word block to a category of word blocks. The method 500 further includes associating 506 the new word block with a behavior analytic rule. Some embodiments may include assigning 508 a weighted value to the new word block for the behavior analytic rule, the weighted values indicating a significance of a potential behavior represented by the word block to a condition of the behavior analytic rule. The method 500 further includes storing 510 the at least one new word block, the association of the new word block with the behavior analytic rule and the weighted value if assigned 508, and the categorization of the at least one new word block in a database.

Following the creation of a new word block, the method 500 in some embodiments includes publishing the new word block and the categorization of the new word block to a portable computing device. The publishing may occur immediately upon the storing 510 of a new word block or at another time.

In some embodiments of the method 500, assigning 508 the weighted value to the new word block for the behavior analytic rule includes assigning a weighted value for each of a plurality of possible classifications of individuals. The plurality of possible classifications may include a possible mental health condition of an individual and a weighting of the new word block as highly indicative of the mental health condition.

Figure 6:
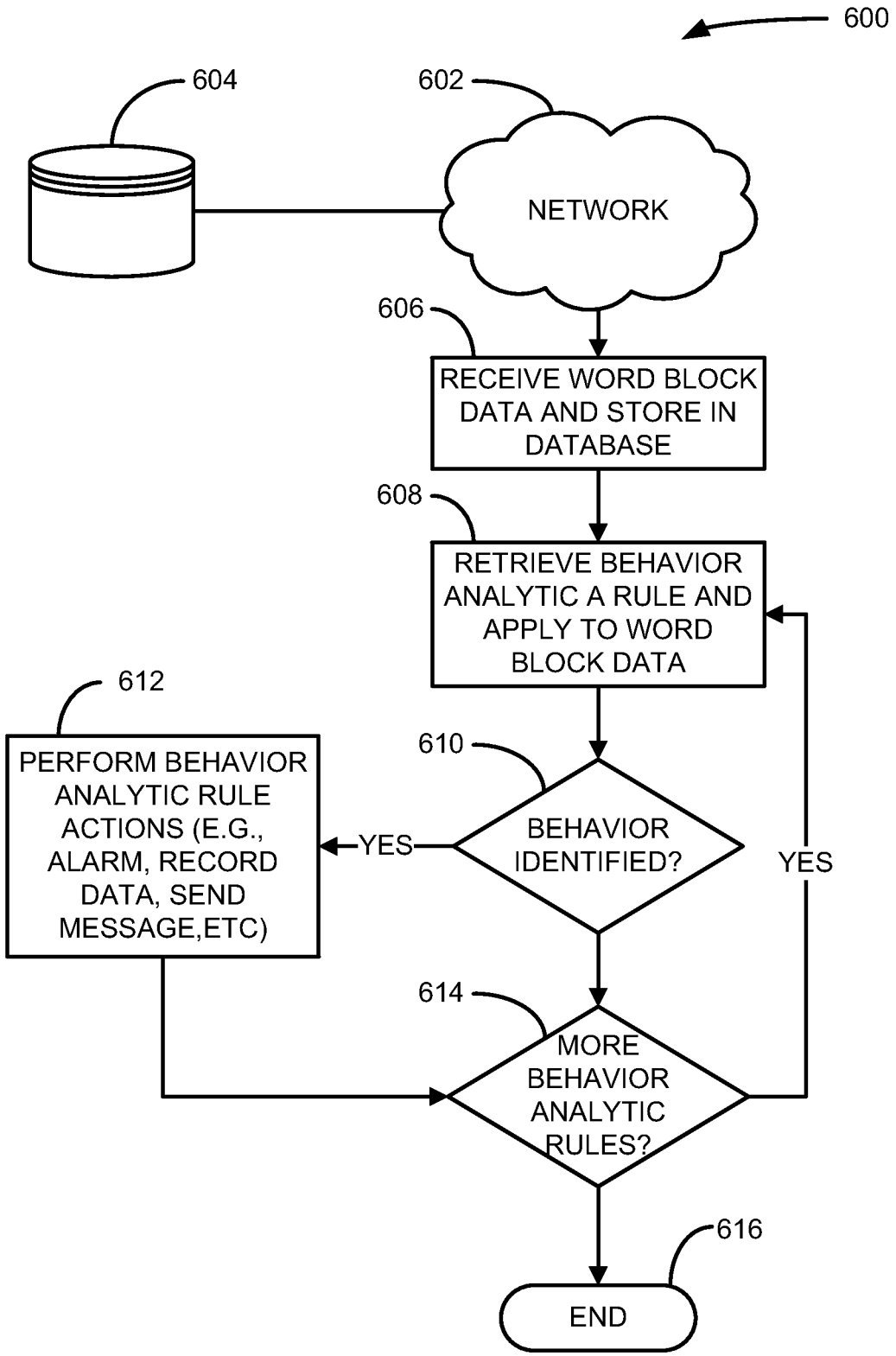
FIG. 6 is a block diagram of a method, according to an example embodiment.

FIG. 6 is a block diagram of a method 600, according to an example embodiment. The method 600 is an example of processing received word block data representative of potential behaviors. The method 600 is typically performed on a computing device, such as a server, to analyze incoming and historical behavior data received via a network 602 and stored in a database 604. The method 600 includes receiving and storing 606 word block data in the database 606. Subsequently and periodically, the method 600 includes retrieving a behavior analytic rule and applying 608 the behavior analytic rule to word block data retrieved from the database 604 to identify potential behaviors. When a behavior is identified 610, the method 600 includes performing an action associated with the behavior analytic rule for which a behavior or condition is identified 610. Following performance, or at least triggering of, the action, or when a behavior of a behavior analytic rule is not identified 610, the method 600 determines 614 if more behavior analytic rules remain to be applied. If so, the next behavior analytic rule is retrieved 608 and the method 600 proceeds. Otherwise, the method 600 ends 616. In some embodiments, retrieval and application 608 of a behavior analytic rule is performed with regard to behavior data of all individuals before the next behavior analytic rule is retrieved and applied. In other embodiments, the behavior analytic rules are all retrieved and applied 608 for an individual before behavior data of the next individual is evaluated.

It will be readily understood to those skilled in the art that various other changes in the details, material, and arrangements of the parts and method stages which have been described and illustrated in order to explain the nature of the inventive subject matter may be made without departing from the principles and scope of the inventive subject matter as expressed in the subjoined claims.

What is claimed is:

1. A method comprising:

receiving, via a network from a portable data processing device storing an inmate database, input representative of at least one behavior of a first individual for which data is stored in the inmate database on the portable data processing device, the received input including data representative of a human selection of at least one presented potential behavior selection option and data representative of a human selection of at least one of a descriptive, qualitative, and noun element related selection option related to the data representative of the at least one behavior of the first individual received on the portable data processing device with regard to at least one human observed behavior of the first individual, the input received within a user interface presented on a display of the portable data processing device that presents the at least one presented potential behavior selection option, the descriptive, qualitative, and noun element related selection options, and inmate data retrieved from the inmate database on the portable data processing device, the presented data including inmate behavioral tendency information, and storing the input in a behavior database with additional data indicating a time the data was received, the behavior database storing data representative of behavior of a plurality of individuals over time;

applying, through execution of instructions on a computer processor, at least one behavior analytic rule to the data stored in the behavior database including the data received with regard to the first individual to determine if the at least one behavior analytic rule is implicated; and when at least one behavior analytic rule is implicated, performing an action as included in the respective behavior analytic rule implicated.

2. The method of claim 1, wherein at least one behavior analytic rule defines an area in which access by the first individual is restricted, whereupon receiving input of indicating presence of the first individual trigger triggers performance of a particular action.

3. The method of claim 2, wherein at least one behavior analytic rule defines an area in which access by the first individual is time-limited, whereupon identification of data stored in the behavior database in violation of the time restriction triggers performance of a particular action.

4. The method of claim 1, wherein:

the received input representative of at least one behavior includes data identifying a location of the behavior of the first individual;

the at least one behavior analytic rule includes a behavior analytic rule that retrieves a location of a second individual from data stored in the behavior database with regard to the second individual; and the at least one behavior analytic rule is implicated when the first and second individuals are within a defined proximity of one another.

5. The method of claim 1, wherein:

the received input representative of at least one behavior includes data representative of a symptom associated with a potential condition, the potential condition represented by a condition behavior analytic rule;

applying the condition behavior analytic rule identifies data representative of behaviors of the first individual stored in the database that are identified in the condition behavior analytic rule as associated with behaviors of the potential condition; and performing the action when the condition behavior analytic rule is implicated includes modifying a monitoring schedule for the first individual.

6. The method of claim 5, wherein the condition behavior analytic rule weights at least one behavior identified in the data representative of behaviors of the first individual in determining whether the condition behavior analytic rule is implicated.

7. The method of claim 1, wherein the at least one behavior analytic rule includes a set of behavior analytic rules that each represent a requirement as defined by at least one of a statute, a regulation, and a best practice for monitoring at least one individual incarcerated within a corrections facility.

8. The method of claim 1, wherein:

the received input includes an identifier of a movement behavior, an identifier of the first individual, data representative of a current location of the first individual within a facility, and a destination location; and the at least one behavior analytic rule implicated includes a rule implicated by the identifier of the movement behavior that watches for subsequent input to be received within a period determined by the implicated behavior analytic rule indicating the first individual has arrived at the destination location, whereupon expiration of the period without receiving the subsequent input triggers performance of the action.

9. The method of claim 8, further comprising:

receiving a query from a requestor for a view of past movement behavior by the first individual;

retrieving data from the behavior database with regard to movement behaviors stored in association with the first individual;

transmitting, to the requestor, data representative of the past movements of the first individual.

10. The method of claim 8, wherein the triggered action is communication, over the network to a facility management system of the facility, of a signal to the facility management system.

11. The method of claim 8, further comprising:

receiving further input with regard to the movement behavior, the further input defining a path of input mechanisms between the current location of the first individual within the facility and the destination location, the input defining the path defining a temporary behavior analytic rule with regard to the first individual, whereupon receipt of further input from an input mechanism not included in the path of input mechanism triggers performance of an alert action.

12. The method of claim 11, wherein the input mechanisms are Radio Frequency Identification (RFID) tag reading devices.

13. An inmate-monitoring system comprising:

a portable computing device including:

at least one mobile device processor, at least one memory device, at least one input device, a display device, and a network interface device;

instructions stored on the at least one memory device and executable by the at least one mobile device processor to:

retrieve, from a database stored in the at least one memory device of the portable computing device, and present, via the display device, information based on identifier input received via the at least one input device, the retrieved and presented information including inmate data, inmate behavioral tendency information, at least one potential behavior selection option, and descriptive, qualitative, and noun element selection options;

receive human selection input of at least one behavior selection option and at least one of a descriptive, qualitative, and noun element selection option, the human selection input representative of the at least one behavior of the inmate; and send data representative of the received human selection input, via the network interface device of the portable computing device, to the inmate-monitoring server;

the inmate-monitoring server including:

at least one computer processor, at least one memory device, and a network interface device;

instructions stored on the at least one memory device and executable by the at least one computer processor to cause the system to:

receive, via the network interface device of the inmate-monitoring server, data representative of the human selection input from the portable computing device, the data representative of the at least one behavior of the inmate and the at least one of the descriptive, qualitative, and noun element related to the data representative of the at least one behavior of the inmate and storing the received data representative of the human selection input in a behavior database with additional data indicating a time the data was received, the behavior database storing data representative of behavior of a plurality of individuals over time;

apply at least one behavior analytic rule to the data stored in the behavior database including the data received with regard to the inmate to determine if the at least one behavior analytic rule is implicated; and when at least one behavior analytic rule is implicated, performing an action as included in the respective behavior analytic rule implicated.

14. The inmate-monitoring system of claim 13, wherein the database stored in the at least one memory device of the portable computing device includes data representative of inmates and locations within a corrections facility.

15. The inmate-monitoring system of claim 13, wherein:

the received selection input representative of at least one behavior includes data identifying a location of the behavior of the first individual;

the at least one behavior analytic rule includes a behavior analytic rule that retrieves a location of a second individual from data stored in the behavior database with regard to the second individual; and the at least one behavior analytic rule is implicated when the first and second individuals are within a defined proximity of one another.

* * * * *